United States Patent [19]

Wells et al.

[11] 4,017,967

[45] Apr. 19, 1977

[54] METHOD OF MAKING INFRARED EMITTER

[75] Inventors: Harold D. Wells, St. Louis County; E. Warner Hughes, Ballwin; Robert F. Bales, Maryland Heights, all of Mo.

[73] Assignee: Black Body Corporation, Fenton, Mo.

[22] Filed: June 7, 1976

[21] Appl. No.: 693,162

Related U.S. Application Data

[63] Continuation of Ser. No. 563,621, March 31, 1975, abandoned.

[52] U.S. Cl. ..... 29/611; 219/345; 338/262; 427/58; 427/294; 427/372 R

[51] Int. Cl.[2] ..... H05B 3/18

[58] Field of Search ..... 29/611; 219/213, 345, 219/353–357, 538, 544, 546, 542; 338/283–294, 315, 316, 311, 269; 427/294, 372, 58; 13/22

[56] References Cited

UNITED STATES PATENTS

| | | | |
|---|---|---|---|
| 1,431,825 | 10/1922 | Lemoine | 338/269 |
| 1,681,956 | 8/1928 | Shriner | 338/269 X |
| 3,479,490 | 11/1969 | Stark | 219/544 |
| 3,496,336 | 2/1970 | Hingorany et al. | 219/544 X |
| 3,500,444 | 3/1970 | Hesse et al. | 219/464 X |
| 3,664,013 | 5/1972 | MacGuire | 219/345 X |
| 3,809,859 | 5/1974 | Wells | 338/254 X |
| 3,952,408 | 4/1976 | Docx | 29/611 |

*Primary Examiner*—Victor A. DiPalma
*Attorney, Agent, or Firm*—Ralph W. Kalish

[57] ABSTRACT

An infrared emitter panel comprising a body of refractory material, a non-helical continuous heating element of serpentine form embedded within said refractory material and having opposed ends projecting through said refractory material for connection in circuit to a source of electrical power. Said body of refractory material is provided with expansion zones adjacent each of the hair pin-like bent ends of said heating element for allowing unimpeded linear expansion and contraction of said heating element upon energization and de-energization respectively. The invention also comprehends a method for forming an infrared emitter panel comprising embedding a non-helical heating element of serpentine form within a non-dried slurry of refractory material and then causing a current to pass through said heating element for causing the development of expansion zones within the refractory material for expansion and contraction of the same as well as for curing and drying the refractory material to render same integrated into compact operational form.

3 Claims, 5 Drawing Figures

METHOD OF MAKING INFRARED EMITTER

This application is a continuation of application Ser. No. 563,621, filed 3/31/75, now abandoned.

BACKGROUND AND SUMMARY OF THE INVENTION

This invention relates in general to infrared radiation and, more particularly, to an infrared emitter panel and method of producing same.

The utilization of infrared emitters of the flat panel type has gained wide acceptance in the industrial field as within equipment for baking, curing, plasticizing, shrink wrapping, and the like. Fundamentally, such panels embody a heating element consisting of an electrical resistor of non-helical form; being customarily of the hair pin or serpentine configuration; and with such element being embedded within refractory material. In view of the non-helical character of such elements, there has been the problem of providing for the expected linear expansion of such elements during heating, and with complementary volume for assuring contraction. If such provision were not made, severe distortion and failure of the element would quickly occur with full impairment of the panel.

Heretofore one expedient for providing requisite volume and expansion and contraction of such elements is set forth and described in U.S. Pat. No. 3,809,859 granted May 7, 1974 wherein the element is maintained in sandwich form between a pair of confronting sheets of refractory material by means of a strip forming anchor extending across the central portion of the heating element to thereby allow the end portions to remain free for suitable linear movement under heating or cooling as the case may be.

Therefore, it is an object of the present invention to provide an infrared emitter panel wherein the non-helical heating element is fully encased within a body of refractory material wherein there are provided expansion chambers for allowing uninhibited linear movement of the various segments of the heating element.

It is another object of the present invention to provide an infrared emitter panel having a non-helical heating element encased within a unitary body of refractory material thereby avoiding the incorporation of cooperating discrete refractory sheets as has been customary, and with such unitary body having enclosed chambers for accommodating the linear expansion and contraction of the heating element.

It is a further object of the present invention to provide a unique method for producing an infrared emitter panel which obviates the necessity of assembling a multiplicity of discretely and independently formed components, such as refractory panels, heating elements, and anchoring devices for the heating element.

It is a further object of the present invention to provide a method of the character stated which may be easily and economically performed; wherein contraction and expansion chambers are provided for the heating elements without preforming through the utilization of extrinsic tools or devices.

It is a still further object of the present invention to provide an infrared emitter panel of the character states which is most reliable in usage; having marked longevity for operational purposes; and which permits of utilization of resistors having substantially greater coefficient of contraction and expansion than heretofore considered feasible in such emitters; and which have marked emissivity factors.

DESCRIPTION OF THE PREFERRED EMBODIMENT

Figure 1:
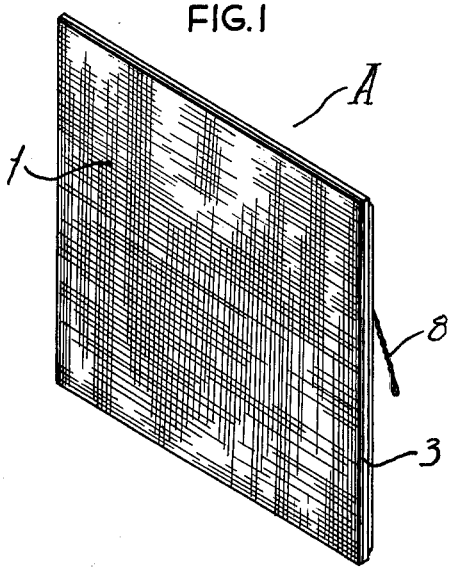
FIG. 1 is a perspective view of an infrared emitter panel constructed in accordance with and embodying the present invention.
Figure 2:
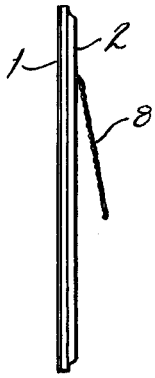
FIG. 2 is an end elevational view of the emitter panel.
Figure 5:
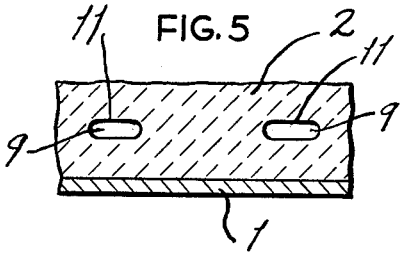
FIG. 5 is a horizontal transverse sectional view taken on the line 5—5 of FIG. 3.

Referring now by reference numerals to the drawings which illustrate the preferred embodiment of the present invention, A generally designates a refractory panel for emission of infrared radiation. Panels of the present invention are usually assembled in multiple panel units incorporating support frames together with grids for effective dispersion, such units being exemplified by the structures disclosed in U.S. Pat. No. 3,493,724. Panel A comprises an outer or forward covering sheet 1 being of mesh character and formed from a suitably high dielectric material, such as, for instance, glass fibers. Such covering sheet 1 is of light weight and with its forward face being usually coated black, such as by a mixture of colloidal silica and black die, in a compatible vehicle, such as water. When dried, the solids produce a black surface which enhances the efficiency of panel A for infrared emission as well as conducing to heat absorptivity for re-emission. Bonded upon the rear face of covering sheet 1 is a co-extensive unitary body of refractory material 2 being relatively thicker than covering sheet 1, but having marginal dimensions of like extent. As is suggested in FIGS. 1 and 2, covering sheet 1 may have edge portions, as at 3, for being turned rearwardly in surrounding relationship to the confronting edge portions of refractory body 2. Said body 2 is fabricated of refractory material, such as ceramic fiber; exemplary of which is a commercial product known as FIBERFRAX which is the trademark of the Carborundum Company for such fiber as made from alumina and silica which may contain small additions of suitable modifiers. Other mineral fibers having a melting point above the operating temperature of the heating element to be described below may be used. It is to be understood that the precise composition of refractory body 2 as well as that of covering sheet 1 do not necessarily form a part of the present invention as there are a multiplicity of materials which may be utilized. It is critical that the refractory material of body 2 be of such character as to be resistant to fracturing as a result of repeated cooling and heating and possess substantial dielectrical strength, together with a relatively low coefficient of thermal expansion consonant with sufficient thermal conductivity for heat transfer therethrough.

Fully embedded within refractory body 2 is a heating element 4 being preferably a single length of electrical resistance wire, such as, for example, NICHROME*, and arranged in a generally back and forth pattern often characterized as serpentine, having a series of substantially coextensive lengths 5 being continuous at their opposite ends through hair pin-like or U-shaped bent ends 6. Heating element 4 is substantially coextensive with, but slightly less than the area of refractory body 2 and may, if desired, be round or flat, with the diameter or cross section, as the case may be, being commensurate with the wattage to be accommodated. By the particular serpentine pattern, the watt density or energy is effectively spread over a substantial area thereby providing for a lower watt density in such relatively broader and wider area at standard voltages as in the order of 115 volts which is especially advantageous with infrared heating. It should be understood that other resistant wires, than those fabricated of NICHROME, are equally effective, such as various iron-aluminum alloys and the like, as NICHROME is set forth for purposes of example only.

*NICHROME is a trademark of Driver Harris Co. for an alloy of nickel, iron, chromium and carbon.

The opposite ends of heating element 4, as at 7, 8, are led outwardly through the opposed side portions of the rear face of refractory body 2 and are of relatively increased cross section, such as through double twisting, as indicated at 7′,8′, respectively, so that during energization of heating element 4 such end portions 7, 8 will be subject to relatively reduced expansion under the developed heat to thereby substantially eliminate possible fracturing of panel A. Thus, end portions 7, 8 are presented externally of panel A for connection to a convenient source of electrical power.

Figure 3:
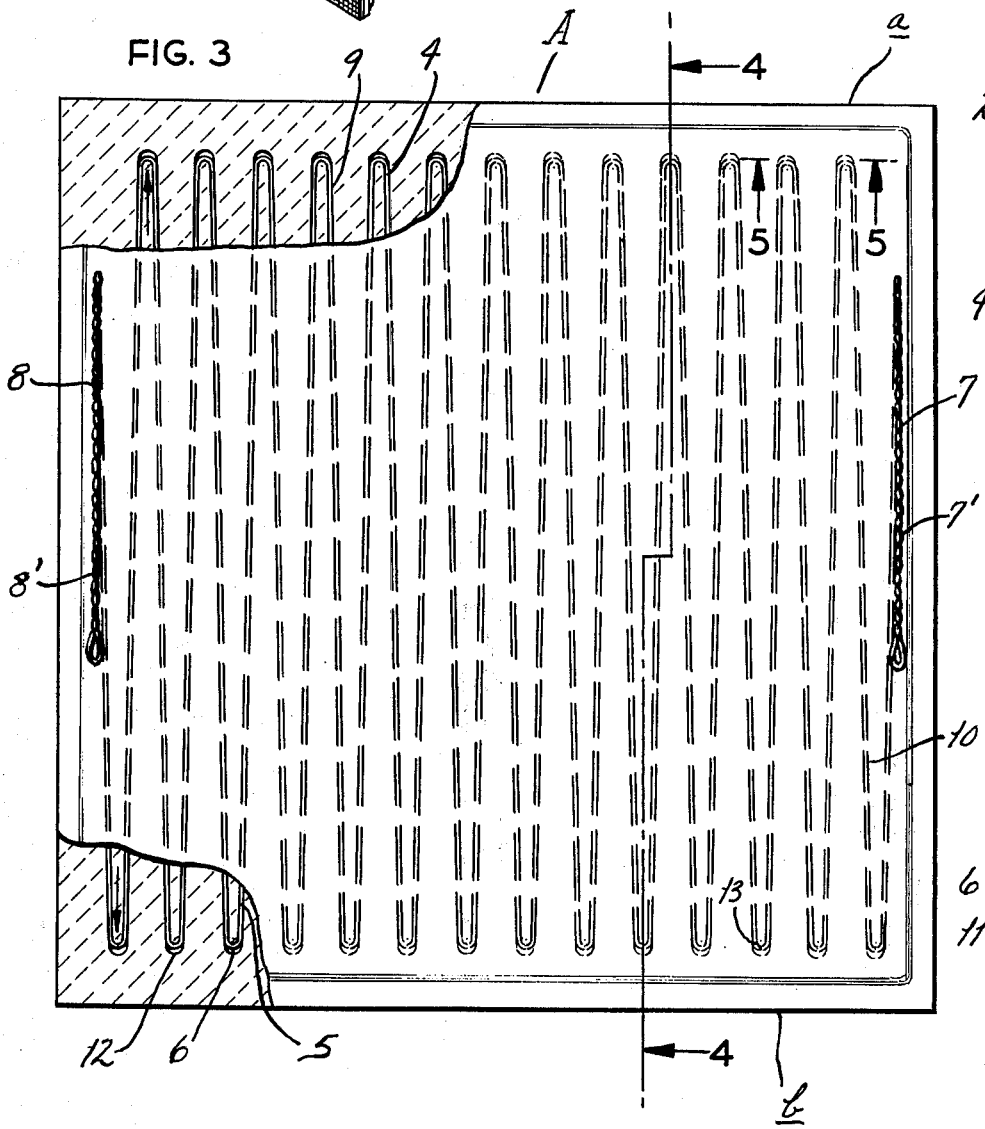
FIG. 3 is a rear view of the panel with a portion of the refractory material broken away.
Figure 4:
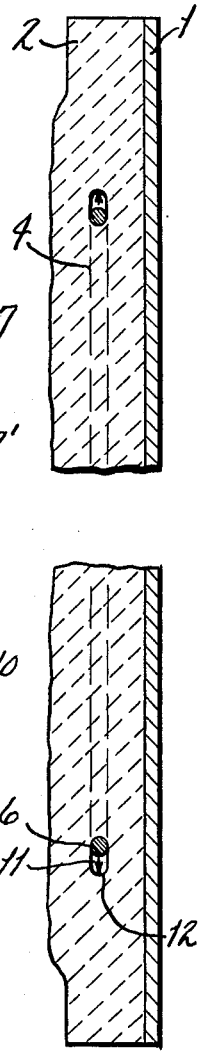
FIG. 4 is a vertical transverse sectional view taken on the line 4—4 of FIG. 3.

As may best be seen in FIGS. 3 and 4, heating element 4 is received within a complementarily formed chamber, generally indicated 9, having elongated sections 10 for accommodating the lengths 5 of said heating element 4 and with such sections 10 being interconnected by end portions 11 which constitute expansion zones of arcuate contour but having their dimension longitudinally of panel A of greater extent than the diameter or cross section of the wire constituting heating element 4, so that when heating element 4 is in normal contracted state, the bent ends 6 will be spaced from the end margins 12 of chamber end portions 11.

By the construction thus described it will be seen that when heating element 4 is energized, as by appropriate manipulation of a control switch connected to the particular source of electrical power, the lengths 5 of said heating element 4 will expand linearly and with the forces of such expansion being relatively great. Through such linear expansion the intervening bent ends 66 will each, expectedly, be forced toward the proximate panel margins *a*, *b*, as the case may be, of panel A whereby said ends 6 will travel within the related chamber end portions 11 of chamber 9; and when fully energized will substantially abut against the inner face of the end margin 12 of such related chamber end portions 11. Upon de-energization, heating element 4 will, understandably, contract and the volume of said chamber end portions 11 will allow of return travel of the now cooling heating element ends 6 away from the proximate margins of panel A, as the case may be, and toward the inner limit, as at 13, of the associated chamber end portions 11. Said chamber end portions 11 are of extreme criticality for the effective, reliable, and long usage of panel A since without the expansion spacing thereby provided, distortions and failure of the heating element 4 would rapidly develop.

By means of the heating element of the present invention the watt density over the surface of panel A provides heat uniformity and eliminates the necessity of reflectors which is of extreme important to the users. Furthermore, the serpentine electrical resistance wire also serves to structurally reinforce panel A permitting it to be made in thinner sections than heretofore with relative reduction in production costs and with the mass allowing for a more rapid "bring up time."

Panel A may be formed by means of a most novel method which comprehends presenting cover sheet 1, as of glass fiber and being of mesh character, in face down position upon a screen, the under portion of which is connected to a vacuum source. Refractory material such as ceramic fiber, together with a binder, as of colloidal silica, prepared in slurry form, is then poured over the upper normally inner face of cover sheet 1 to a thickness in the order of ⅛ of an inch. A vacuum is then drawn on the slurry so as to effect a partial withdrawl of water to reduce the erstwhile slurry to a partially dried, but yet plastic, state. The vacuum is at that juncture discontinued and the heating element 4 which has been preformed into the above described serpentine character having the ends 7, 8 bent with respect to the major plane of heating element 4, is then placed upon the partially dried layer of refractory material and thereupon a like slurry of ceramic fiber and colloidal silica is presented coveringly upon the heating element 4 in coextensivity with the covering sheet 1 as by means of forming elements provided on the screen retaining device. By the application of such slurry, element 4 is entirely embedded within the refractory body which now has an overall thickness of about ¼ inch, but may even proximate ½ inch. By reason of the partially dried state of the initially applied slurry, the binder, such as colloidal silica, has not been permitted to harden for forming the requisite bond. The ends 7, 8 of heating element 4 are connected in circuit to a source of electric power which is then energized to cause a current to flow through heating element 4 and which by reason of the resistance of its material of construction will cause the development of heat which serves a multiplicity of purposes in completing the formation of panel A. Thus, the heat developed within element 4 will complete the curing of the enclosed refractory body 2 to bring same to a fully dried state and with the binder, as colloidal silica, uniting the constituents of the refractory body and the sheet 1 into intimate panel formation. However, during such energization of heating element 4, the latter will expand linearly and since the refractory material has not as yet been completely cured will forcefully cause the development of chamber end portions 11. Accordingly, the hair pin bent ends 6 of heating element 4 act as forming tools, not altogether unlike a mold, as they develop the chamber end portions 11 while the refractory material is still in a relatively plastic state. Upon de-energization of said element 4 bent ends 6 thereof will move in the opposite direction through the expected contraction of said element 4 and thereby perfect the integrity of the chamber end portions.

From the foregoing it will be seen that the present method is most unique in that it effectively utilizes the forces of expansion and contraction of the heating element 4 for completing the chamber formation while also utilizing the developed heat for curing the refractory body 2 so that an integrated panel is produced.

Thus with the complete drying of the colloidal silica the chamber end portions 11 are of stable condition.

The present invention, while obviating the necessity of utilizing relatively complex tools, dies, and the like, for molding or forming the expansion zones created by chamber end portions 11, also permits of rapidity of production by inexpensive equipment.

Having described our invention what we claim and desire to obtain by Letters Patent is:

1. A method for forming a refractory panel for emission of infrared radiation comprising providing a sheet of dielectrical material of mesh character, applying to one face of said dielectric sheet a slurry of refractory material and a binder, applying a vacuum through the opposite face of said dielectrical sheet for partial drying of said slurry, providing a non-helical resistance wire heating element, placing said heating element upon said partially dried slurry of refractory material, then making a second application of said slurry upon said partially dried slurry to fully encase said heating element, and then applying a current to said heating element for causing heating of the same to fully cure the refractory material and simultaneously cause expansion of said heating element to effect development of an enlarged chamber within the refractory material as cured.

2. A method for forming a refractory panel as defined in claim 1 and further characterized by said heating element being of serpentine form and having opposed ends, causing said ends to project through, and outwardly of, the second slurry application, connecting said ends to a source of electrical power for energizing said heating element.

3. A method for forming a refractory panel as defined in claim 1 and further characterized by said firstly applied slurry having a thickness of about approximately ⅛ of an inch and said secondly applied slurry having substantially like thickness.

* * * * *